US005519427A

United States Patent [19]

Cavarero et al.

[11] Patent Number: 5,519,427

[45] Date of Patent: May 21, 1996

[54] INK RIBBON HOLDER FOR THERMAL-TRANSFER PRINTER

[75] Inventors: Eric Cavarero, Honorine; Pascal Boishardy, Sauteuil; Patrick Vegeais, Paris, all of France

[73] Assignee: Societe d'Applications Generales d'Electricite, France

[21] Appl. No.: 285,419

[22] Filed: Aug. 3, 1994

[30] Foreign Application Priority Data

Aug. 3, 1993 [FR] France ..... 93 09539

[51] Int. Cl.[6] ..... B41J 32/00

[52] U.S. Cl. ..... 347/214; 400/207; 400/208; 400/208.1

[58] Field of Search ..... 346/76 PH; 400/207, 400/208, 208.1; 347/214

[56] References Cited

U.S. PATENT DOCUMENTS

| | | | |
|---|---|---|---|
| 4,160,605 | 7/1979 | Neubaum | 400/208 |
| 4,723,133 | 2/1988 | Walter | 400/602 |
| 4,944,619 | 7/1990 | Suzuki et al. | 400/208 |
| 5,352,049 | 10/1994 | Shiraishi et al. | 400/208 |
| 5,354,134 | 10/1994 | Patry | 400/208 |

FOREIGN PATENT DOCUMENTS

| | | |
|---|---|---|
| 0475404 | 3/1992 | European Pat. Off. . |
| 0488291 | 6/1992 | European Pat. Off. . |
| 0521521 | 1/1993 | European Pat. Off. . |
| 0546944 | 6/1993 | European Pat. Off. . |

*Primary Examiner*—Huan H. Tran
*Attorney, Agent, or Firm*—Graham & James

[57] ABSTRACT

A cassette for thermal-transfer printing ribbon (2), designed to be fitted in a printer comprising a printing head (21) in front of which sheets of paper (30) are intended to pass and comprising a housing (3; 103) for accommodating a delivery spool (4; 104), a housing (5; 105) for accommodating a take-up spool (6; 106), means (8; 108) designed to be driven in rotation and drive the take-up spool (6; 106), a window (9; 109) being made between the two housings (3, 5; 103, 105) and designed to allow interaction of the printing head (21) and the ribbon (2) extending between the two housings (3, 5; 103, 105).

9 Claims, 1 Drawing Sheet

INK RIBBON HOLDER FOR THERMAL-TRANSFER PRINTER

BACKGROUND OF THE INVENTION

1. Field of the Invention

The field of the invention is that of printers, peripheral printers of central processing units and printers integrated with printing apparatuses such as facsimile machines.

2. Discussion of Related Art

Two main types of printer are known: printers using laser printing and printers using thermal printing. The field of the invention is that of the latter printers. Printers using thermal printing, provided with a head of resistive heating elements use either thermal paper in roll form or ordinary paper in sheets as the printing medium.

The field of the invention is, even more particularly, that of printers using thermal printing employing sheets of ordinary paper that is to say printers using thermal-transfer printing. The printing is carried out under the action of the printing head, by transfer of a thermally meltable ink, previously laid on a support film, the whole forming a printing ribbon. The invention relates to these printing inking ribbons which consequently have a width at least equal to that of the sheets intended to be printed.

Fitting these ribbons in a printer involves a handling operation requiring many precautions if it is desired not to waste length while ensuring correct tension of the ribbons.

The present invention aims to dispense with such a handling operation.

SUMMARY OF THE INVENTION

For this purpose, it relates to a cassette for thermal-transfer printing ribbon, designed to be fitted in a printer comprising a printing head in front of which sheets of paper are intended to pass and comprising a housing for accommodating a delivery spool, a housing for accommodating a take-up spool, means designed to be driven in rotation and drive the take-up spool, a window being made between the two housings and designed to allow interaction of the printing head and the ribbon extending between the two housings.

It is therefore sufficient to introduce into the printer, in the manner in which other cassettes are introduced into other apparatuses in different fields, the ribbon holder constituted by the cassette of the invention, previously loaded with two spools, one for delivering and one for taking up an inking ribbon, in order for this ribbon to be ready for use.

Advantageously, the cassette is monobloc.

Also advantageously, the window made between the two housings is designed to allow interaction of the ribbon and a support head.

In the preferred embodiment of the cassette of the invention, means for guiding sheets of paper are associated with each of the two housings.

It is advantageous for means for deviating the path of the ribbon between the two housings to be associated with the housing of the take-up spool in order, after printing, to facilitate separation of the ribbon and the sheets of paper.

Preferably, means for guiding sheets of paper and means for deviating the path of the ribbon forming a chicane are associated with the housing of the take-up spool.

The cassette of the invention may be symmetrical with respect to a mid-plane passing through the window.

In this case, it may be advantageous to provide means designed to drive the spools of the two housings in rotation. This is the case of a reversible cassette in which it is naturally possible for only one of the two spools to be actually driven by the printer at a given time, after the cassette has been reversed on itself, the inking ribbon of this cassette being suitable for two printing runs.

Still in this case, and advantageously, the rotational drive means of the two spools are respectively arranged on two opposite sides of the cassette.

BRIEF DESCRIPTION OF THE DRAWINGS

The invention will be better understood with the aid of the following description of the preferred embodiment of the cassette of the invention, with reference to the attached drawing, in which.

DETAILED DESCRIPTION OF THE PREFERRED EMBODIMENTS

Figure 1:
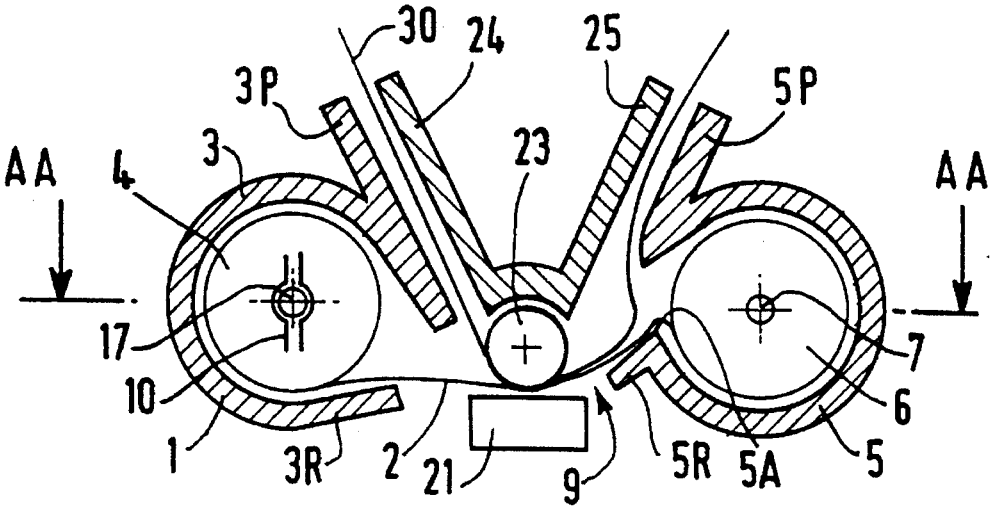
FIG. 1 is a view in lateral section of the cassette of the invention.
Figure 2:
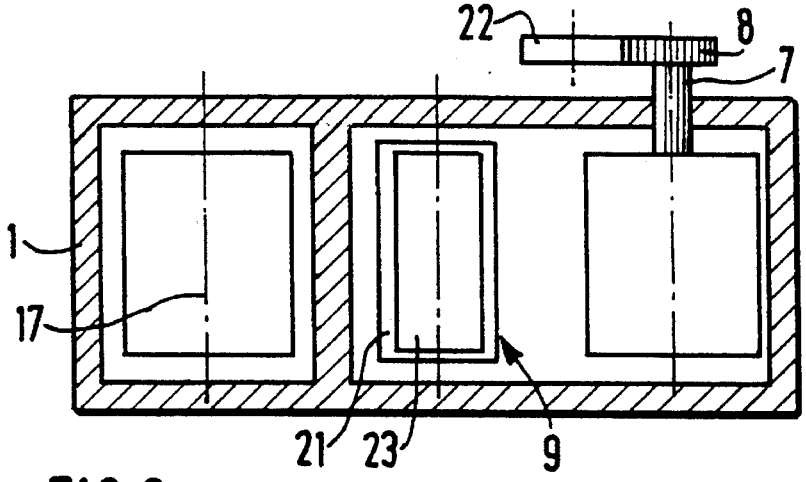
FIG. 2 is a plan view of the cassette along the section AA in FIG. 1

The cassette represented in FIGS. 1 and 2 includes a casing 1 containing a thermal-transfer printing ribbon 2. The cassette is designed to be fitted in a printer, not fully shown, which in this case belongs to a facsimile machine and comprises a line printing head 21 in front of which the sheets of paper 30 to be printed are intended to pass. The cassette comprises a housing 3 for accommodating a spool 4 for delivering the ribbon 2, a housing 5 for accommodating a take-up spool 6 and, in the take-up housing 5, a driveshaft 7 which includes grooves for rotational coupling with the take-up spool 6 and ending in a gear 8 projecting from the casing 1 containing the above elements. A geared 22 motor of the printer meshes on the gear 8 in order to drive it in rotation and thereby drive the take-up spool 6. A window 9 is made between the two housings 3 and 5 and is here designed to allow interaction of the printing head 21 and the ribbon 2 extending between the two housings 3 and 5.

The support roller 23 of the printer is opposite the printing head 21 and presses the paper 30 and the ribbon 2 against the printing head 21, while driving the paper 30 by friction.

A shaft 17 is here provided for supporting the delivery spool 4, as well as a brake 10 opposing the rotation of the shaft 17.

The ribbon 2 upstream of the printing head 21 leaves the housing 3 while being guided or deviated by an extension 3R of the housing 3, extending toward the printing head 21, while the ribbon 2 downstream of the printing head 21 is guided or deviated, by an extension 5R of the housing 5. In this example, the extensions 3R and 5R are designed so that the ribbon 2 upstream is approximately straight, while the ribbon 2 downstream is guided approximately to an edge of the housing 5 opposite the extension 5R, as far as a rounded edge 5A causing it to follow a chicane path from which it re-emerges toward a neighboring edge of the extension 5R while forming, very approximately, a right angle. Because of this, as shown by FIG. 1, the ribbon 2 and the sheet 30 of printed paper remain attached between the printing head 21 and the edge 5A, where they are separated through a relatively large angle. The ribbon 2 is pulled by the action of the motor 22 and remains tensioned by the effect of the brake 10 while the paper 30 is pushed by the roller 23. Drive wheels may also be provided for extracting the paper 30.

The housings 3 and 5 respectively have two other extensions 3P and 5P which guide the paper 30, on entry, toward the head 21 and, upon exit, from the head 21. Two guides 24 and 25 are respectively associated with the extensions 3P and 5P, which extensions belong to one and the same part of the printer and respectively are arranged facing the extensions 3P and 5P in order to constitute with them two channels for guiding the paper 30 on entry and on exit.

The cassette is here monobloc and the window 9 allows the printing head 21 and the support roller 23 to occupy a position interposed between the two housings 3 and 5 for which position they interact.

Although this scarcely seems to be economical, it would have been possible to provide for the cassette to be fitted with a support roller.

Figure 3:
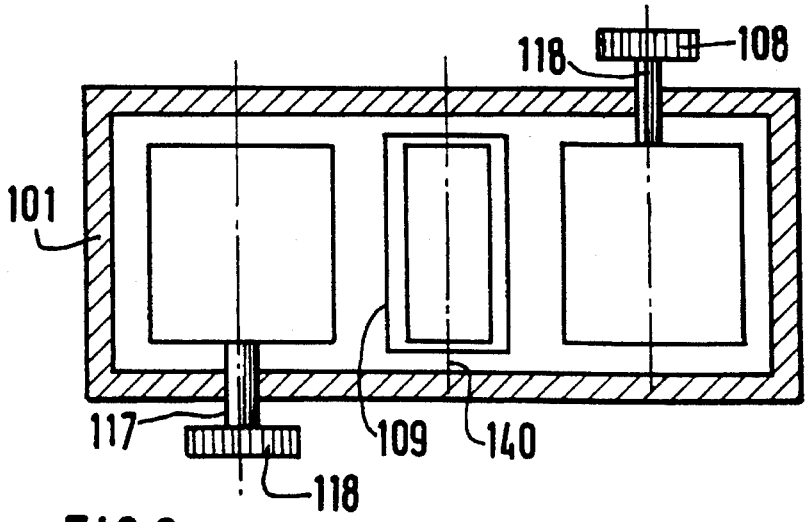
FIG. 3 is a plan view in section of a symmetrical and reversible cassette.

The cassette represented in FIG. 3 has a general shape, and elements, similar to those represented in FIGS. 1 and 2, with the exception that it has symmetry with respect to a mid-plane 140 passing through the window 109. Because of this, elements similar to those in FIGS. 1 and 2 bear identical references, preceded by the hundred digit 1 and, where appropriate, the ten digit 1, and they are not described a second time.

The cassette in FIG. 3 carries two layers of ink, allowing two printing runs. The cassette includes a second gear 118 integral with the shaft 117, for driving the spool 104 in rotation when, the cassette having been reversed in the printer, the spool 104 occupies therein the preceding position, represented, of the take-up spool 105 and is driven by the motor 122. The second gear 118 is arranged on a side of the casing 101 opposite that from which the gear 108 projects, in order to take the place of the latter after reversal of the cassette.

It would also have been possible to provide, by replacing the gears 108 and 118, shafts 107 and 117 which are hollow and splined and optionally symmetrical with respect to the mid-plane 140 and which are accommodated on two pins of the printer, one of which would have been the drive pin.

I claim:

1. A cassette for thermal-transfer printing ribbon (2), designed to be fitted in a printer comprising a printing head (21) in front of which sheets of paper (30) are intended to pass, said cassette comprising a housing (3; 103) for accommodating a delivery spool (4; 104), a housing (5; 105) for accommodating a take-up spool (6; 06), means (8; 108) designed to be driven in rotation and drive the take-up spool (6; 106), a window (9; 109) between the two housings (3, 5; 103, 105) adapted to allow interaction of the printing head (21) and the ribbon (2), wherein said cassette further comprises means (3P, 5P) for guiding sheets of paper (30) integral with each of the two housings (3, 5; 103, 105), said guiding means cooperating with adjacent means on the printer to effect the guiding of sheets of paper.

2. A cassette for thermal-transfer printing ribbon (2), designed to be fitted in a printer comprising a printing head (21) in front of which sheets of paper (30) are intended to pass, said cassette comprising a housing (3; 103) for accommodating a delivery spool (4; 104), a housing (5; 105) for accommodating a take-up spool (6; 106), means (8; 108) designed to be driven in rotation and drive the take-up spool (6; 106), a window (9; 109) between the two housings (3, 5; 103, 105) adapted to allow interaction of the printing head (21) and the ribbon (2), wherein said cassette further comprises extension means (5R, 5A) integral with the housing (5) for accommodating the take up spool, for the path of the ribbon (2) between the two housings (3, 5; 103, 105) to deviate in order, after printing, to facilitate separation of the ribbon (2) and the sheets of paper (30).

3. A cassette for thermal-transfer printing ribbon (2), designed to be fitted in a printer comprising a printing head (21) in front of which sheets of paper (30) are intended to pass, said cassette comprising a housing (3; 103) for accommodating a delivery spool (4; 104), a housing (5; 105) for accommodating a take-up spool (6; 106), means (8; 108) designed to be driven in rotation and drive the take-up spool (6; 106), a window (9; 109) between the two housings (3, 5; 103, 105) adapted to allow interaction of the printing head (21) and the ribbon (2), wherein means (5P) for guiding sheets of paper (30) and means (5A) for deviating the path of the ribbon (2), between the two housings, forming a chicane are integrated with the housing (5) of the take-up spool (6).

4. The cassette according to claim 3, characterized by the fact that it is monobloc (1; 101).

5. The cassette according to claim 3, wherein the window (9; 109) made between the two housings (3, 5; 103, 105) is designed to allow interaction of the ribbon (2) and a support roller (23).

6. The cassette according to claim 3, characterized by the fact that it has symmetry with respect to a mid-plane (140) passing through the window (109).

7. The cassette according to claim 6, wherein means (107, 108, 117, 118) are provided which are designed to drive the spools (104, 106) of the two housings (103, 105) in rotation.

8. The cassette according to claim 7, wherein the rotational drive means (107, 108, 117, 118) of the two spools (104, 106) are respectively arranged on two opposite sides of the cassette.

9. A cassette for thermal-transfer printing ribbon (2), designed to be fitted in a printer comprising a printing head (21) in front of which sheets of paper (30) are intended to pass, said cassette comprising a housing (3; 103) for accommodating a delivery spool (4; 104), a housing (5; 105) for accommodating a take-up spool (6; 106), means (8; 108) designed to be driven in rotation and drive the take-up spool (6; 106), a window (9; 109) between the two housings (3, 5; 103, 105) adapted to allow interaction of the printing head (21) and the ribbon (2), wherein said cassette further comprises means (3P, 5P) for guiding sheets of paper (30) integral with each of the two housings (3, 5: 103, 105), said guiding means cooperating with adjacent means on the printer to effect the guiding of sheets of paper, wherein said cassette further comprises extension means (5R, 5A) integral with the housing (5) for accommodating the take up spool for causing the path of the ribbon (2) between the two housings (3, 5; 103, 105) to deviate in order, after printing, to facilitate separation of the ribbon (2) and the sheets of paper (30), wherein means (5P) for guiding sheets of paper (30) and means (5A) for deviating the path of the ribbon (2) forming a chicane are integrated with the housing (5) of the take-up spool (6).

* * * * *